United States Patent [19]

Griffis

[11] Patent Number: 4,985,057

[45] Date of Patent: Jan. 15, 1991

[54] SUPPLIED AIR RESPIRATOR SYSTEM

[76] Inventor: Steven C. Griffis, 2929 Avenue D, Council Bluffs, Iowa 51501

[21] Appl. No.: 391,174

[22] Filed: Aug. 9, 1989

[51] Int. Cl.[5] ..... B01D 46/12

[52] U.S. Cl. ..... 55/269; 55/318; 55/321; 55/324; 55/385.2; 55/467; 55/472; 134/200; 134/110

[58] Field of Search ..... 55/269, 318, 322, 324, 55/385.1, 385.2, 467, 472, 484, 500, 321; 134/200, 110

[56] References Cited

U.S. PATENT DOCUMENTS

| | | | |
|---|---|---|---|
| 3,496,203 | 2/1970 | MacLeod et al. | 55/318 X |
| 3,775,949 | 12/1973 | Wachter | 55/467 X |
| 4,774,974 | 10/1988 | Teter | 134/110 |
| 4,850,380 | 7/1989 | Koslow | 134/200 X |

*Primary Examiner*—Charles Hart

*Attorney, Agent, or Firm*—Zarley, McKee, Thomte, Voorhees & Sease

[57] ABSTRACT

A supplied air respirator system is described for use in an enclosed work area wherein an asbestos abatement action is being conducted. A conventional air filtration unit is provided and which has its discharge side in communication with a clean air box. Positioned within the clean air box is a HEPA filter intake box having a HEPA filter contained therein with the discharge side thereof being connected to one or more air pumps. The discharge side of each of the air pumps is connected to an air cooler or heat exchanger coil unit, filter system and hose reel assembly. The heat exchanger coil unit cools the compressed air with the filter systems positioned downstream thereof being utilized to remove any excess condensation from the cooled air.

7 Claims, 2 Drawing Sheets

SUPPLIED AIR RESPIRATOR SYSTEM

BACKGROUND OF THE INVENTION

This invention relates to a supplied air respirator system and more particularly to a supplied air respirator system designed to be used within an enclosed work area wherein an asbestos abatement action is taking place.

In the early 1940's, asbestos was an inexpensive material which was used in virtually every industrial plant across the nation because of its superior capabilities of noise reduction, insulating and fire retardant qualities. Asbestos was used in cement asbestos pipe, plaster, wiring, pipe insulation, sound absorbing tiles, floor tiles and sprayed on ceiling structural steel and deck pans.

Asbestos has been found to be a health hazard and asbestos removal or abatement programs are being conducted to remove these health hazards. Many regulations have been adopted and are in place to ensure the safety of those workers who are removing the asbestos as well as to ensure that the asbestos being removed will not be introduced into the surrounding atmosphere. For example, U.S. Pat. No. 4,604,111 describes a fairly common system which is employed in an asbestos removal project. In most projects, an enclosure is created around the space in which the asbestos is to be removed.

Workers within the enclosed contaminated area wear protective clothing including masks having an air hose extending therefrom for supplying a source of breathing air thereto. If the air compressors or pumps for the breathing masks are located within the contaminated enclosed area, there is a possibility that contaminated air will be supplied to the workers. Additionally, the air compressors or pumps supplying air to the workers heat the air during compression thereby making the breathing air warmer than room temperature thereby creating an uncomfortable and unhealthy breathing situation.

It is therefore a principal object of the invention to provide a supplied air respirator system.

Still another object of the invention is to provide a supplied air respirator system for use in an enclosed work area wherein an asbestos abatement action is taking place.

Yet another object of the invention is to provide a supplied air respirator system which filters the air to provide at least class D breathing air to the worker.

Still another object of the invention is to provide a supplied air respirator system including means for cooling the air after it has been compressed.

Still another object of the invention is to provide a supplied air respirator system which is economical of manufacture and durable in use.

These and other objects will be apparent to those skilled in the art.

SUMMARY OF THE INVENTION

Figure 1:
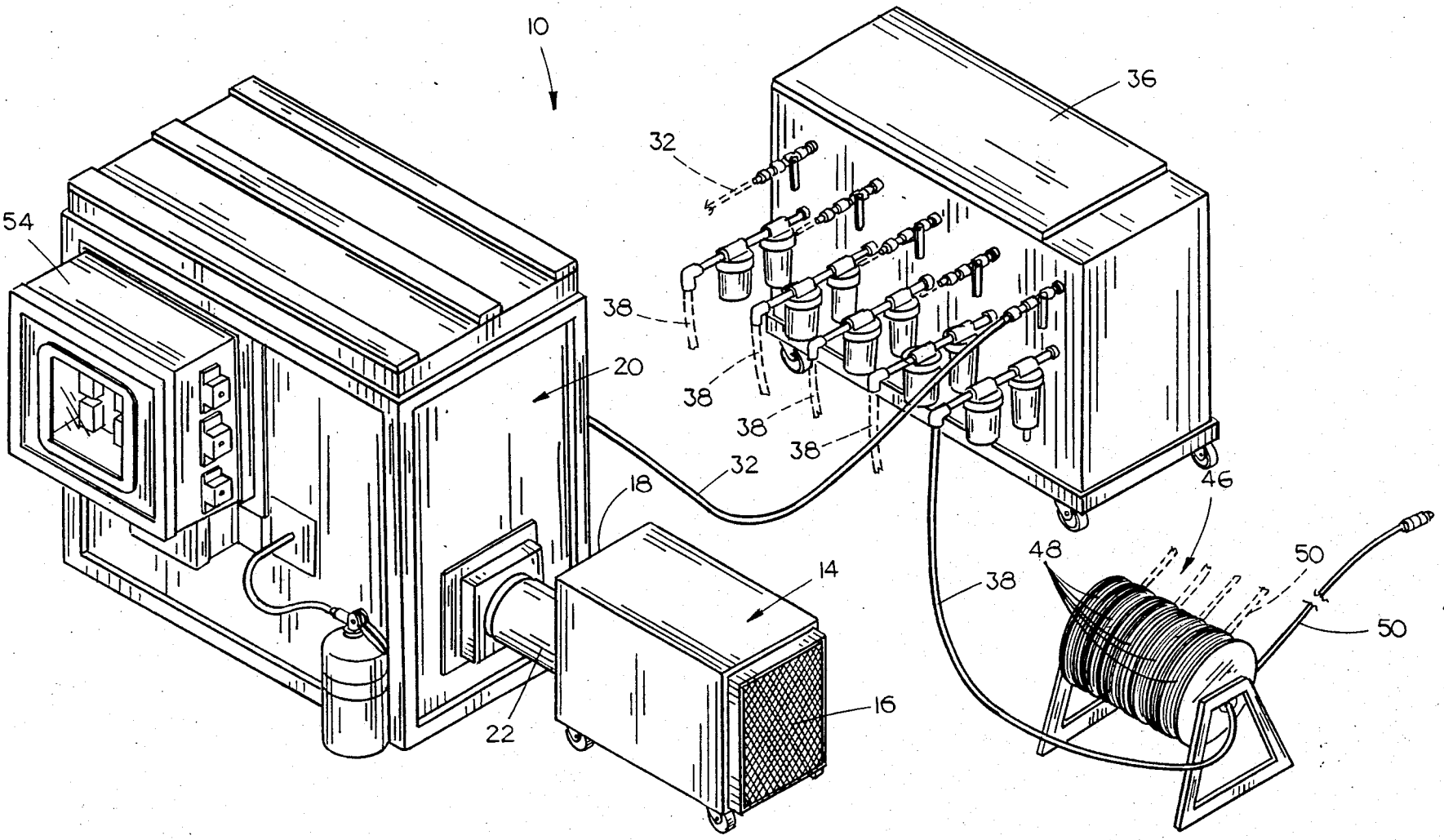
FIG. 1 is a perspective view of the supplied air respirator system of this invention.
Figure 2:
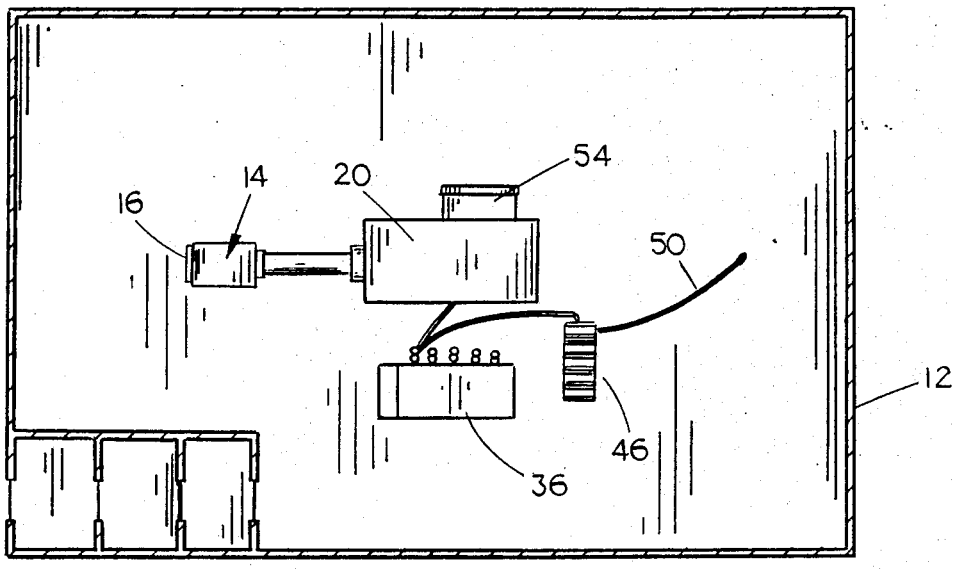
FIG. 2 is a schematic view illustrating the supplied air respirator system of this invention being utilized within an enclosed work area wherein an asbestos abatement action is taking place.
Figure 3:
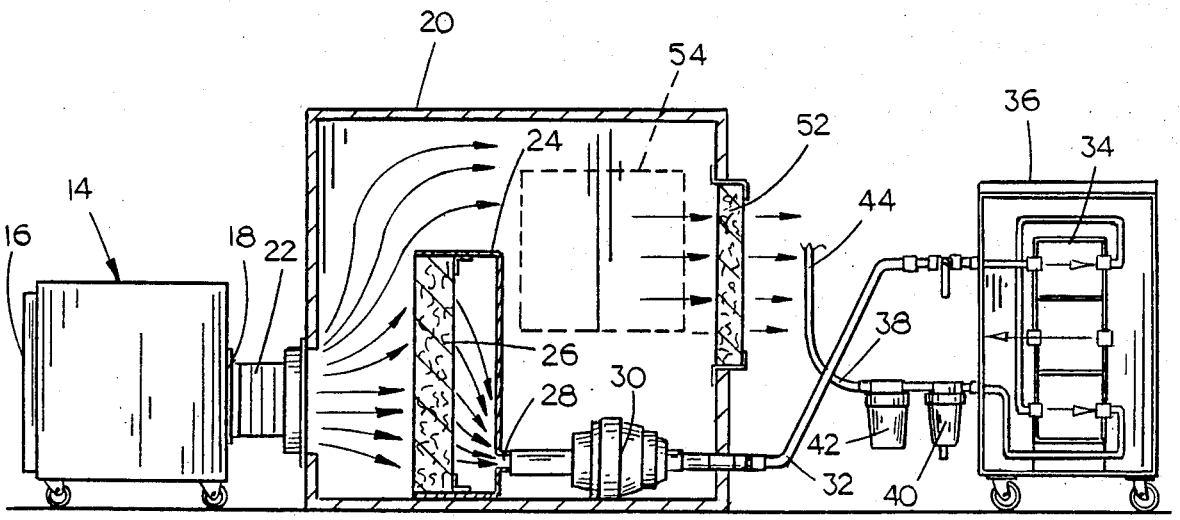
FIG. 3 is a sectional view illustrating the supplied air respirator system of this invention.

A supplied air respirator system for use by workers in an enclosed contaminated work area wherein an asbestos abatement action is taking place comprising a negative air machine with a HEPA filter designed to supply air to a clean air box. Within the clean air box is a filter intake box having another HEPA filter contained therein. Air is supplied from the HEPA filter intake box to one or more air pumps having the discharge sides thereof operatively connected to an air cooler box. The discharge side of the air cooler box is operatively connected to a hose reel assembly having hoses mounted thereon which are designed to be connected to the breathing masks of the workers. Any excess air within the filter box is discharged through a pleated filter back into the work area.

DESCRIPTION OF THE PREFERRED EMBODIMENT

The supplied air respirator system of this invention is referred to generally by the reference numeral 10 and is designed to be positioned within an enclosed work area 12 in which asbestos abatement procedures are being conducted.

System 10 includes a first conventional air filtration unit 14 having its intake end or side 16 in communication with the interior of area 12 and its discharge side 18 in communication with the interior of an airtight air cabinet or air box 20 by means of conduit 22.

HEPA filter intake box 24 is positioned within box 20 and has a HEPA filter 26 positioned in the intake end thereof. The intake box 24 is provided with a discharge 28 which is operatively connected to one or more air pumps 30. Any number of air pumps 30 may be provided within the box 20 although for purposes of this description, only a single air pump 30 will be described. It is preferred that one air pump 30 be provided for each five workers requiring supplied air.

The discharge side of air pump 30 has a hose or pipe 32 extending therefrom to a fin type heat exchanger or air cooler 34 located within air cooler box 36. It is anticipated, and preferred, that one air cooler unit 34 be provided for each air pump 30. The discharge side of the air cooler unit 34 has a pipe or hose 38 extending therefrom in which a moisture remover filter 40 and an in-line air filter 42 are imposed. Preferably, moisture remover filter 40 is of the 40 micron type while filter 42 is of the 5 micron type. Hose or line 44 extends from filter 42 to a hose reel assembly 46 having five reels 48 mounted thereon. A hose 50 extends from each of the reels 48 for connection to the breathing mask of the individual worker. It is preferred that a reel 48 be provided for each worker and that additional hose reel assemblies are provided for each five workers. FIG. 1 illustrates that only a single hose 32 extends from the clean air box 20 to the air cooler box 36 but it should be understood that additional hoses 32 will be provided for each five workers requiring supplied air.

It should be noted that the capacity of the air filtration machine 14 is greater than the capacity of the air pumps 30 contained within the clean air box 20. A pleated filter 52 is provided in the clean air box to permit excess air within the box 20 to be discharged therefrom. The numeral 54 refers to an air pump starter box positioned on the clean air box 20 to control the operation of the various air pumps within the box 20.

In use, the supplied air respirator system 10 of this invention is positioned within the enclosed area 12 as previously described. Assuming that a single worker requires clean breathing air, but remembering that any number of workers can be supplied breathing air, the negative air machine 14 is actuated as is the pump 30. Clean air is discharged from the discharge side of negative air machine 14 and is discharged into the interior of box 20. Air is filtered through the filter 26 and is fed to the intake side of the pump 30 which compresses the same and supplies the same to the heat exchanger coil unit 34 where the heated and compressed air is cooled. After the air is cooled in the unit 34, it passes through the 40 micron filter 40 and the 5 micron filter 42 to remove any condensation resulting from cooling the air. The cooled air is then supplied to the respirator mask of the worker to provide clean, cool breathing air to the worker. As previously stated, the output of the negative air machine 14 is greater than the capacity of the pumps 30 which results in excess air being discharged from the box 20 through the filter 52.

As stated, each air pump 30 feeds air to one heat exchanger coil unit, filter system, and hose reel assembly as described above. Additional air pumps, heat exchanger coil units, filter systems, and hose reel assemblies are added to the supplied air respirator system of this invention as needed to accommodate work crew size.

Thus it can be seen that the invention accomplishes at least all of its stated objectives.

I claim:

1. A supplied air respirator system for use in an abatement area, comprising, an airtight cabinet means in said abatement area having an interior compartment, said cabinet means having an inlet opening formed therein, a first air filtration unit positioned in said cabinet means and having an intake side and a discharge side, the intake side of said first air filtration unit being in communication with the inlet opening of said cabinet means, a second air filtration unit positioned in said cabinet means and having intake and discharge sides, the intake side of said second air filtration unit being in communication with the interior compartment of said cabinet means, said discharge side of said second air filtration unit being in communication with said abatement area, at least one air pump means in said cabinet means and having intake and discharge sides, the intake end of said air pump means being in communication with the discharge side of said first air filtration unit, an air cooler means in said abatement area having intake and discharge sides, the intake end of said air cooler means being in communication with the discharge side of said air pump means, at least one hose means in said abatement area having one end thereof in communication with the discharge side of said air cooler means, the other end of said air hose means adapted for connection to the air mask of a worker in said abatement area so that cooled air is supplied to the mask of the worker.

2. The supplied air respirator system of claim 1 wherein an air filter means is imposed between the discharge side of said air cooler means and said hose means for removing excess moisture from the cooled air.

3. The supplied air respirator system of claim 1 wherein said cabinet means has a filtered discharge opening formed therein to permit excess air to discharge from said cabinet means.

4. The supplied air respirator system of claim 1 wherein a plurality of air pumps are provided in said cabinet means and wherein a plurality of cooling units are provided in said air cooler means.

5. The supplied air respirator system of claim 4 wherein a plurality of air hoses are operatively connected to said air cooler means.

6. The supplied air respirator system of claim 5 wherein said air hoses are mounted on hose seals.

7. The supplied air respirator system of claim 1 wherein the output of said second air filtration unit exceeds the intake capacity of said air pump means.

* * * * *